US007571805B2

(12) United States Patent
Cunningham

(10) Patent No.: US 7,571,805 B2
(45) Date of Patent: Aug. 11, 2009

(54) AUTOGRAPH BOARD

(76) Inventor: Michael Cunningham, 650 W. Commodore Blvd., Jackson, NJ (US) 08527

( * ) Notice: Subject to any disclaimer, the term of this patent is extended or adjusted under 35 U.S.C. 154(b) by 310 days.

(21) Appl. No.: 11/426,957

(22) Filed: Jun. 28, 2006

(65) Prior Publication Data

US 2008/0149505 A1 Jun. 26, 2008

Related U.S. Application Data

(60) Provisional application No. 60/696,396, filed on Jul. 1, 2005.

(51) Int. Cl.
*B65D 85/00* (2006.01)
*B65D 73/00* (2006.01)
*G09F 1/10* (2006.01)

(52) U.S. Cl. ..... 206/315.1; 40/124.06; 206/232; 206/315.9; 206/470; 206/579

(58) Field of Classification Search ..... 40/124.01, 40/124.4, 800, 124.03, 124.06; 206/232, 206/315.1, 315.9, 459, 5, 461–471, 579; 281/45; 248/444.1
See application file for complete search history.

(56) References Cited

U.S. PATENT DOCUMENTS 2,551,354 A * 5/1951 Wasilevich ..... 206/315.9
3,848,547 A * 11/1974 Schaefer ..... 281/45
5,082,110 A 1/1992 Hager
5,306,049 A * 4/1994 Schireck ..... 206/232
5,356,136 A 10/1994 Ippolito
D357,500 S 4/1995 Mutterperl
5,462,167 A * 10/1995 Polinski et al. ..... 206/470
5,841,878 A 11/1998 Arnold et al.
5,845,778 A * 12/1998 Hickey, Jr. ..... 206/459.5
6,025,040 A * 2/2000 Brockley ..... 40/800
6,442,879 B1 * 9/2002 Callendar et al. ..... 40/800
6,736,429 B1 5/2004 Steeg
D498,502 S 11/2004 Duke
D553,690 S * 10/2007 Cunningham ..... D20/10
7,445,118 B2 11/2008 Schroeder

FOREIGN PATENT DOCUMENTS

FR 2634741 A1 * 2/1990
JP 2002269260 4/2004

* cited by examiner

*Primary Examiner*—Bryon P Gehman
(74) *Attorney, Agent, or Firm*—Fox Rothschild, LLP

(57) ABSTRACT

An autograph board includes a removable cover so that the object to be autographed can be protected when not being autographed. The board is in a shape suggestive of the sport involved, for example, a home plate for a baseball. Removable frame supports allow the board to freely stand on a flat surface for display purposes. A clip holds a pen on the edge of the board.

7 Claims, 5 Drawing Sheets

AUTOGRAPH BOARD

CROSS REFERENCE TO RELATED APPLICATIONS

This application claims the priority of provisional U.S. application Ser. No. 60/696,396, filed on Jul. 1, 2005 and entitled "Autograph Board" by Michael Cunningham, the entire contents and substance of which are hereby incorporated in total by reference.

BACKGROUND OF THE INVENTION

1. Field of the Invention

The invention relates to a board for holding a baseball and uncovering same so that it can be autographed.

2. Description of Related Art

It is increasingly important and usually required for professional and semi-professional athletes to devote a portion of their time to signing autographs for fans.

Prior to this invention a fan would approach a sports athlete and attempt to get an autograph by passing a ball and pen through a group of frantic fans. The athlete must then remove the cap of the pen, awkwardly clutch the pen and ball and attempt a freehand signature on the curved surface. This process usually creates an autograph of poor quality. The athlete must then recap the pen if he remembers what he did with it and attempt to pass the ball and pen back to the same fan. This is frequently a young fan with mustard covered hands. The fan will then attempt to hold the cherished souvenir throughout the sporting event in hands or oiled covered glove. The ball may be dropped on the dirty abrasive concrete or roll down several sections of soda covered rows further blemishing the ball and reducing its quality and value.

Additionally, some athletes and their signatures may not be well known and fans may forget which athlete signed the ball.

Furthermore, upon return home if not immediately placed in a display case the ball can be further exposed to fingerprints, dust, chew marks and loss.

There have been prior art attempts to provide protection for memorabilia such as baseballs and hockey pucks. One is described in US Patent Publication Number US2003/0144094 A1. That publication describes a removable cover for a ball or puck and which includes a window or "autograph opening" through which the athlete can inscribe his or her autograph. A writing implement is attachable to the device by an attachment means. The invention does not appear to provide a support for the ball holder and, in addition, the "autograph opening" means that dust and light can affect the ball over time.

U.S. Pat. No. 6,736,429 describes an invention in which the sports object itself, for example, a simulated basketball, etc., has a pen receiving hole in it attached to the autographable object by a tether. Obviously, the ball is non-functional given the hole therein.

U.S. Pat. No. 5,356,136 is of interest in that it describes another ball and pen combination in which the pen is curved and is attachable to the ball by hook and loop material such as Velcro®.

Japanese Patent JPO 2004 106241A appears to describe another device for holding a ball. A trading card includes a section for writing an autograph and, apparently, a card case also.

U.S. Pat. D5,841,878 describes another device for holding a collectable item, for example, a card, with an autograph space and includes multi-media capability, all within a protective housing.

U.S. Design Pat. D357,500 describes a combined pen and holder for a sports ball such as a baseball.

U.S. Pat. No. 5,082,110 also describes a case for holding an autograph ball.

Lastly, U.S. Design Pat. D498,502 describes yet another device for holding a ball in a display cube.

Insofar as understood, none of the prior art taken individually or in combination describes a baseball holder or holder for a similar item and which can be presented as a whole to an athlete and provides support for the athlete to properly sign the autograph and which thereafter can be mounted on the wall or set on a table or the like in a truly integrated fashion.

SUMMARY OF THE INVENTION

Briefly described, the invention comprises an autograph board for holding and storing an object such as a baseball or the like so that a quality autograph can be obtained and the object safely stored for posterity. The autograph board comprises primarily a flat board section and a spherical ball cover or protection section. In the case of a baseball, the autograph board itself has a shape suggestive of home plate and evocative of baseball images. The ball itself sits in the center of the board and includes a hemispherical shaped ball receiving section having an interior diameter that is approximately the same as the exterior diameter of the ball it holds. This is important because it prevents the ball from rotating while being autographed by the athlete. A front cover is attached to the board by a hinge and is closable to completely seal the ball in the autograph board device. The invention is symmetrical and has a right and left side palm support area so that the athlete can support his or her hand while autographing the ball which is restrained from rotating by the tight fit in the hemispherical ball receiving means located on the backside of the board. An aperture at the top of the board allows the invention to be carried by a handle. This is especially helpful for young children. The rear surface of the board is equipped with slots that can receive supporting legs so that the autograph board can stand up on a table or flat horizontal surface for display purposes. Alternatively, the board can be hung from a nail or the like from a wall. Ideally, however, the autograph board can plug into another frame which is substantially deep enough so that the entire autograph board can be mounted on a wall in an attractive fashion.

These and other features of the invention will be more fully understood by reference to the following drawings.

DESCRIPTION OF THE PREFERRED EMBODIMENT

During the course of this description like numbers will be used to identify like elements according to the different figures that illustrate the invention.

Figure 1:
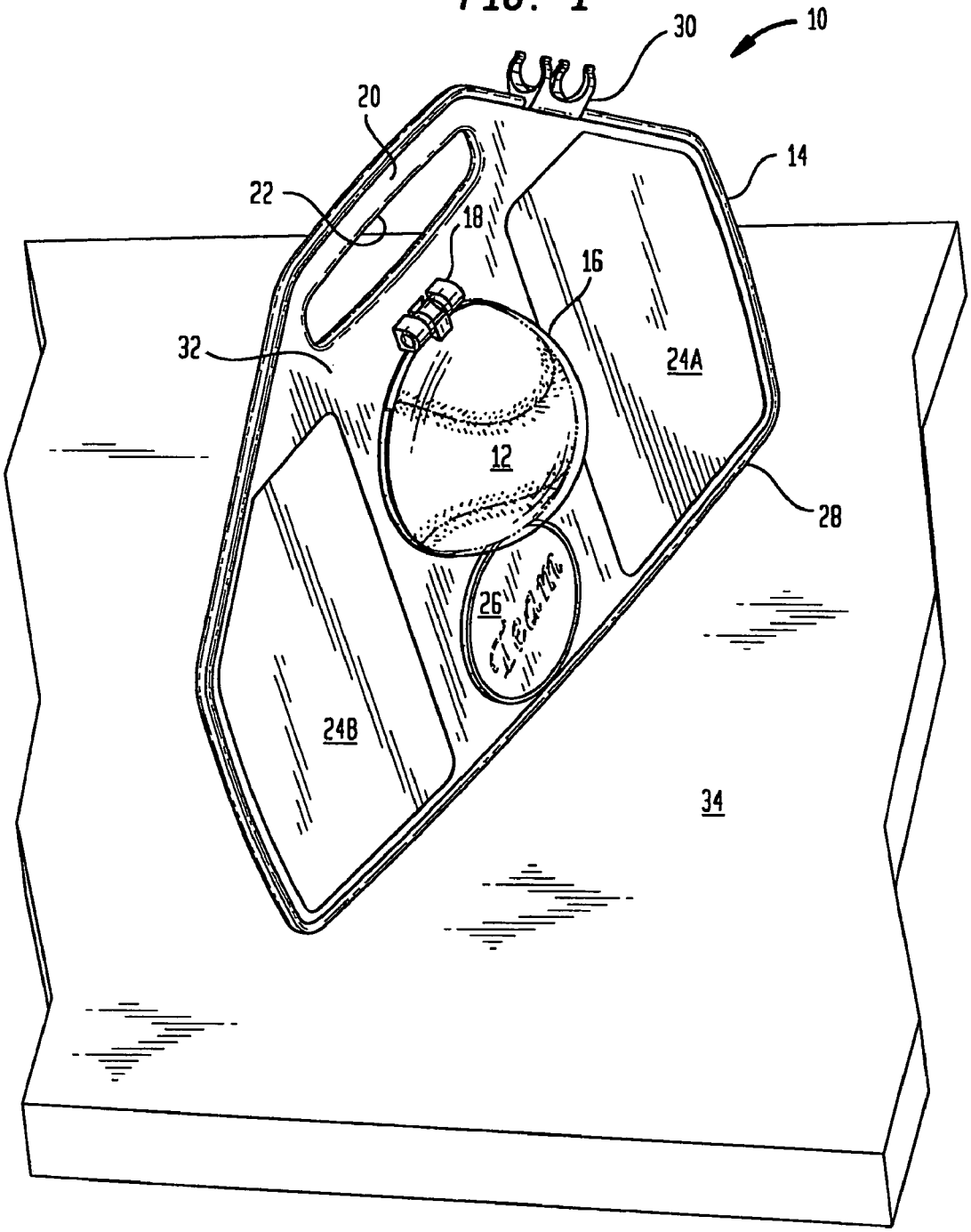
FIG. 1 is a front perspective view of the autograph board according to the preferred embodiment of the invention shown resting on a tabletop.
Figure 2:
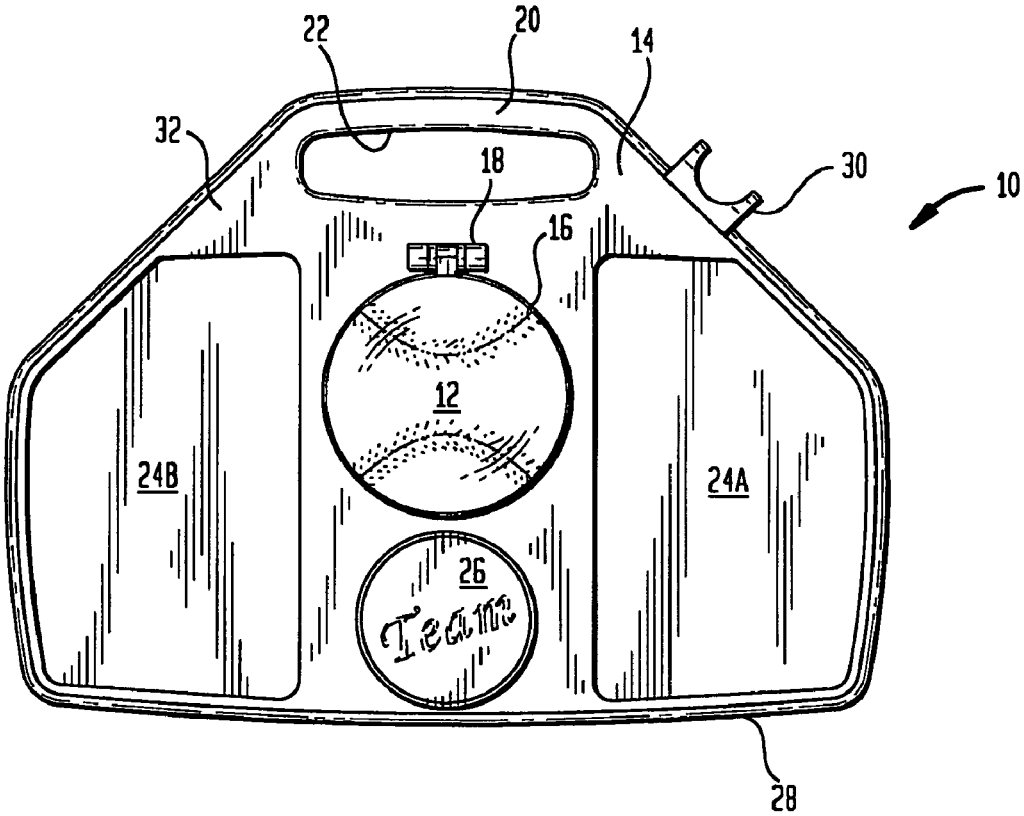
FIG. 2 is a front elevational view of the autograph according to the preferred embodiment as seen as in FIG. 1.
Figure 7:
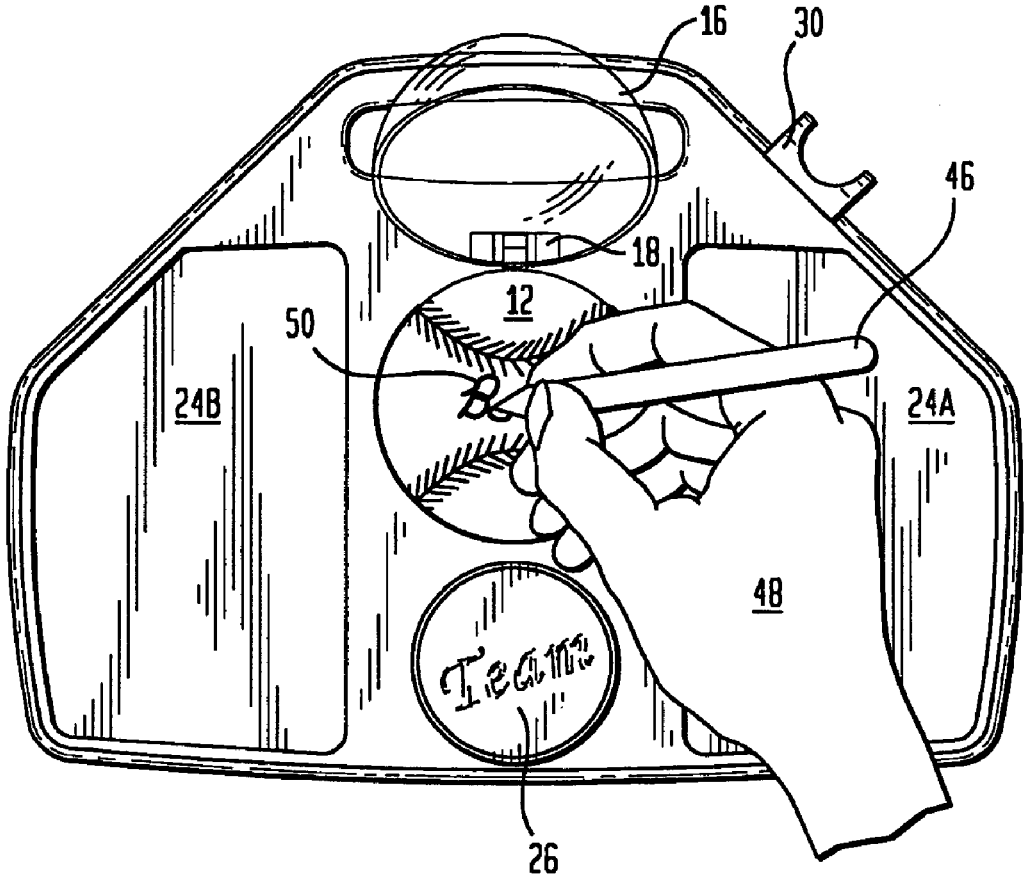
FIG. 7 shows the autograph board being autographed by an athlete wherein the cover has been rotated backwards and the hand of the athlete rest comfortably on the palm support area while the ball is restrained from rotating by its snug fit within the ball receiving cavity.

FIG. 1 is a front perspective view of the preferred embodiment of the invention 10 shown resting on a flat horizontal surface 34 such as a table. The invention 10 is intended, in this particular preferred embodiment, to protect a baseball 12 but it could be any other object such as a hockey puck, a tennis ball, softball, etc. The primary parts of the invention 10 comprise a board 14 and a cover 16 connected to the board 14 by a hinge 18. A handle section 20 is formed by a handle hole 22 at the top of the board 14. A right palm support area 24A appears to the right of the cover 16 whereas a left palm support area 24B appears on the left of the cover 16. Palm support areas 24A and 24B are intended to support the right and left palm of the athlete signing the ball 12. A team logo area 26 is positioned directly below the cover 16 and is intended for customization. For example, the logo of the New York Yankees, Boston Red Sox, The Chicago Cubs, etc. could be placed at that location. Board 14 includes an edge 28 to which a removable pen clip holder 30 is attachable. Removable pen clip holder 30 is intended to support an ink pen 46 such as shown in FIG. 7. Obviously, the pen 46 could be a baseball bat shaped ball point pen or the like. The idea is that the pen 46 is intended to be indelible and of the sort that would make a long lasting and visible autograph 50 such as also shown in FIG. 7. The elements 12-30 just described are all seen on the front face surface 32 of the invention 10 as illustrated in FIGS. 1 and 2 in particular. Part of the novelty of the invention 10 is that the board 14 is suggestive of the sport being honored. In the case of the preferred invention 10, the board 14 is generally suggestive of home plate. In the case basketball, for example, the board 14 might be circular and in the case of football it might be in the shape of a football. The table surface 34 shown in FIG. 1 could be a table top, a dresser, a shelf or other similar horizontal surface.

Figure 3:
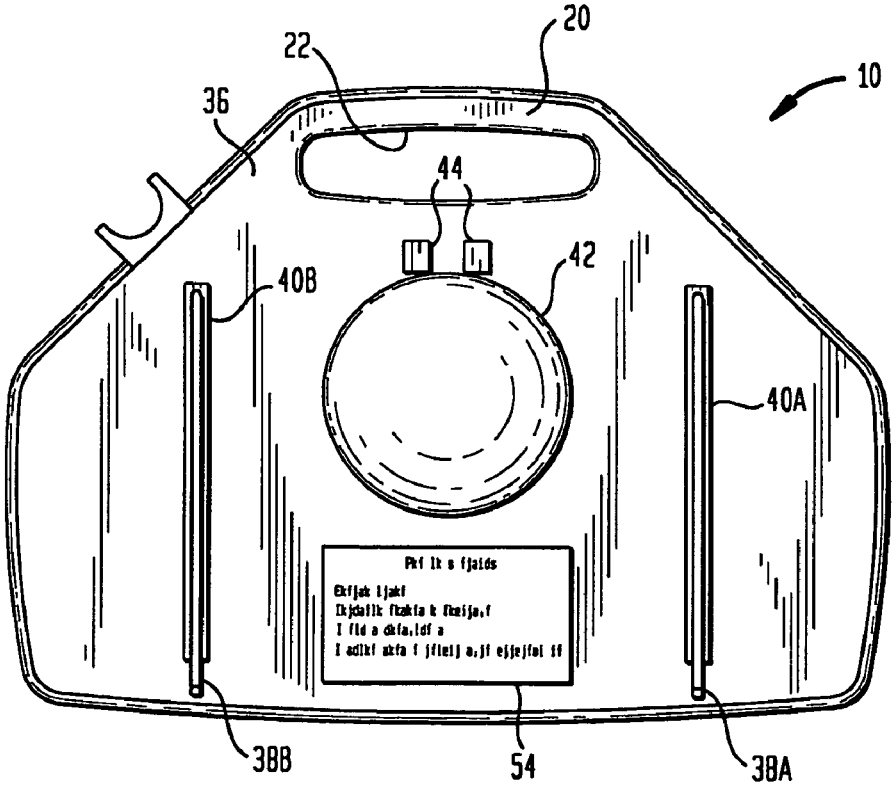
FIG. 3 is a rear elevational view of the autograph board shown in FIGS. 1 and 2.
Figure 4:
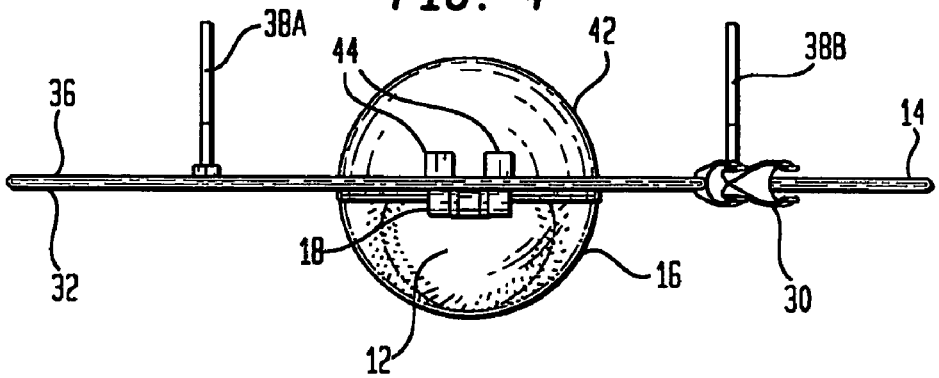
FIG. 4 is a top plan view of the autograph board.
Figure 5:
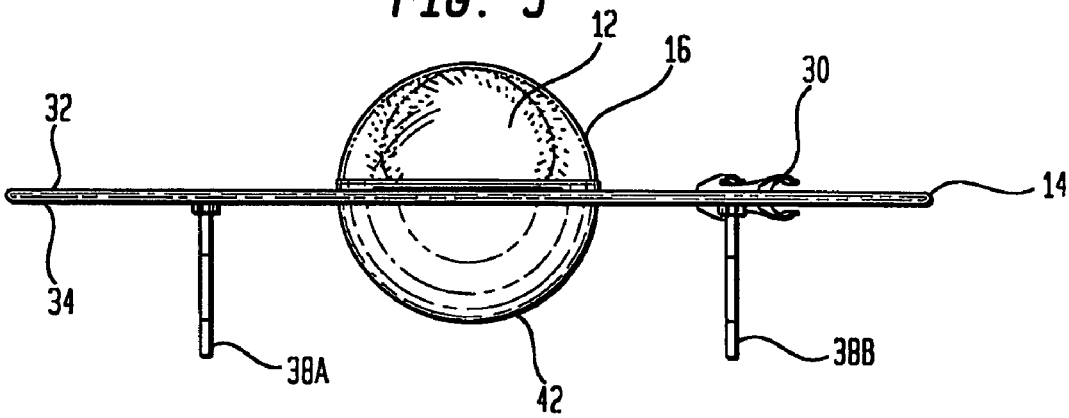
FIG. 5 is a bottom plan view of the autograph board.

The rear surface 36 of the board 14 is illustrated in FIG. 3. In addition, the invention 10 is seen in a top-plan view in FIG. 4 and in a bottom-plan view in FIG. 5. As seen in FIGS. 3-5, the rear surface includes a pair of selectively attachable right and left frame supports 38A and 38B respectively. Right and left frame supports 38A and 38B are receivable in right and left slots 40A and 40B. The frame supports 38A and 38B might be supplied separately in a package and later inserted into the slots 40A and 40B if needed for support. An important part of the invention 10 comprises the hemisphere shaped ball receiving means 42 located on the rear surface 36 of the board 14. A critical feature of the invention is that the inside diameter of the hemisphere 42 is substantially the same as the outside diameter of the ball 12 so that the ball 12 does not rotate when autographed. Also visible from the rear surface are the back anchors 44 of the hinge 18.

Figure 6:
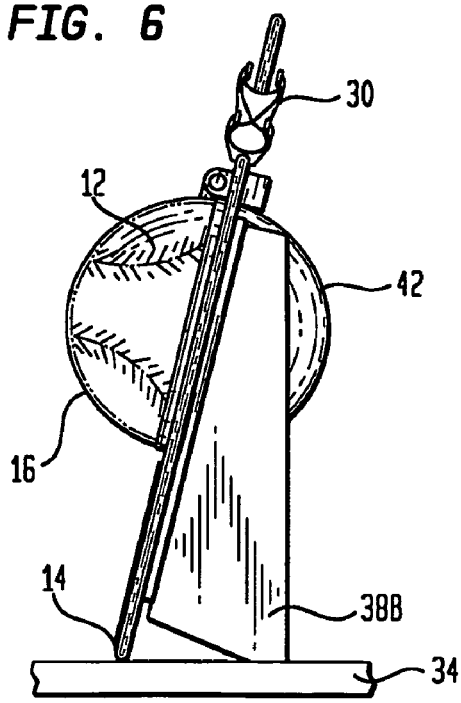
FIG. 6 is a right side elevational view of the autograph board with detachable legs resting on a horizontal table surface similar to that shown in FIG. 1.

FIG. 6 illustrates the invention 10 in the reclining mode in which the supports 38A and 38B make contact with the horizontal table surface 34.

FIG. 7 illustrates the manner in which the invention 10 is used. First, the autograph seeker hands the apparatus 10 to the athlete who in turn removes the cover 16 revealing the ball 12. Second, the athlete then takes the pen 46 in his or her hand 48 and removes it from clip 30. Third, the athlete rests his or hand 48 on either right or left palm support area 24A and 24B, thereby giving the athlete the optimum support while he or she autographs the ball 12 with an autograph 50 which is optimally legible and done with a pen 46 having indelible, black or blue ink. Fourth, when finished, the athlete gives the invention 10 back to the autograph seeker who permanently closes the cover 16 and replaces the pen 46 in the pen holder clip 30. Fifth, the autograph seeker might then also write in some details of the encounter on the label 54 as shown in FIG. 3. For example, it might read, "Baseball signed by Sammy Slugger on Jun. 18, 2006, when he pitched a no-hitter against the New York Yankees. Witnessed, Alfred Autograph Hunter".

Figure 8:
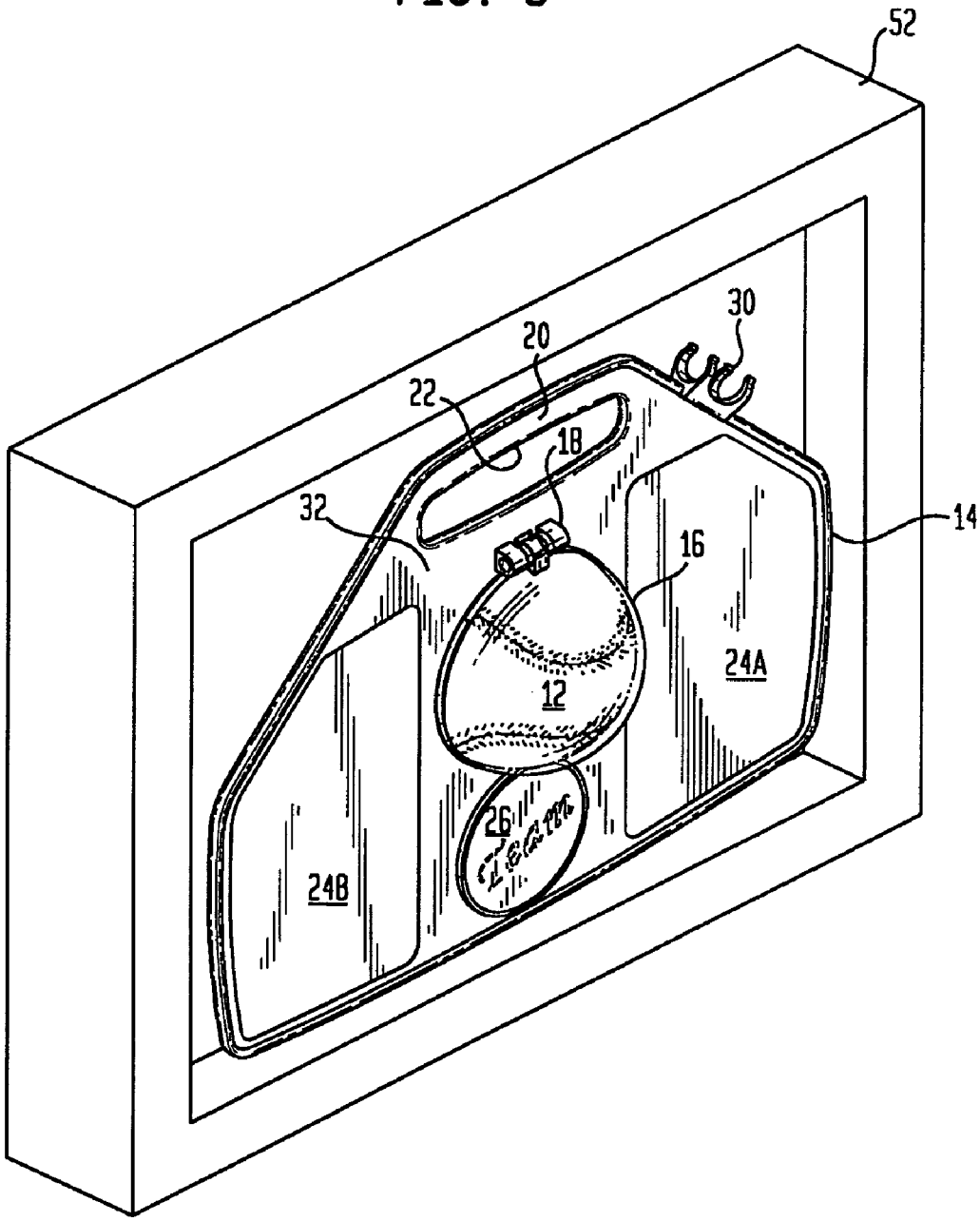
FIG. 8 illustrates the manner in which the autograph board can be plugged into a shadow box-like frame and hung attractively from a vertical flat surface such as a wall.

According to an alternative embodiment illustrated in FIG. 8, the entire invention 10 may be pressed into a deep shadow box type frame 52 and hung on a wall or similar surface.

In summary, the invention 10 provides a number of advantages over the prior art. It enhances the ability of obtaining an autograph 50 from an athlete. Also, the ball 12 remains shielded from the elements in an unblemished condition which enhances the quality and value of the ball 12.

The method of obtaining the autograph is also greatly enhanced. The present invention 10 allows an athlete to easily accept the board 14 from a fan, flip up the protective, clear cover 16, remove the pen 46 from the affixed clip 30 and sign the ball 12 in a comfortable position either on their lap or cradle in their arms. Most importantly, the signature 50 will be made effortlessly with the heal of the hand 48 resting on the board 14 providing a clear and distinct signature 50. The athlete 48 then closes the clear cover 16 locking the ball 12 in place and replaces the pen 46 to the clip 30 and hands the board 14 back to the fan.

Additionally, the board 14 has ample room for display of the team logo 26 or sports figure graphic.

Once the ball 12 is signed, the fan or autograph seeker can then carry the board 14 to a seat or vehicle confident that the autographed ball 12 is secure and unblemished.

Located on the back of the board is a label 54 capable of documenting the fan's personal information if lost and a ledger documenting dates and those athletes who signed the ball.

Further, board 14 can be expanded to accommodate multiple balls 12 or even a team photo.

After leaving the sporting event the invention 10 can stand upright for display on a table 34 or desktop. The board 14 can also be hung from its handle 20 always keeping the board in an unblemished appearance. The ball 12 remains in the board invention 10 ready for its next trip to the park, signing or show. The autograph board 14 itself is also ink receptive adding to the ability of garnering multiple signatures.

According to the preferred embodiment, the board is made of durable, one-eight (⅛) inch ABS plastic or like product. It preferably measures approximately six (6) inches wide by eleven (11) inches high. A four (4) inch wide and one (1) inch high cut out 20 located at the top provides a handle 22 for carrying purposes. Centered on the board is the circular well 42. The well 42 should be deep enough to accommodate half the circumference of the ball 12 or a hockey puck or the like. When the sports ball 12 is placed in the well 42 the remaining one-half circumference is covered by the clear plastic cover 16 which might, for example, be of archival quality and include UV resistant plastic. Once the ball 12 is autographed the clear plastic cover 16 locks in place to secure the ball 12. Once enough signatures are obtained it might be possible to even permanently lock the cover 16 so the ball 12 cannot be removed.

Located on the edge 28 of the board is the pen 46. The pen, perhaps in the shape of a baseball bat, can be removed from the holding clip 30 and returned as desired.

In conclusion, the autograph board 10 invention provides a number of important advantages over the prior art.

First and foremost, it provides a very convenient way to obtain a high quality, indelible signature 50 and store the same in a safe environment.

Second, a pen 46 is provided with high quality archival ink so that the ink does not fade and so that the signature or autograph 50 is bold and readable.

Third, the cover 16 may be made of UV resistant glass or the like to protect the ball 12 from damaging UV radiation in a manner similar to which pictures are often protect by UV resistant glass.

Fourth, the cover 16 can be selectively removed and when the autograph 50 is complete, replaced to its full protective position thereby protecting the ball from dirt, hand smudges and the like. Alternatively, the cover 16 may be permanently locked into position when the autograph process is complete.

Fifth, when the athlete is autographing the ball 12 he or she can rest his or her right or left hand 48 on the palm support areas 24A and 24B. In this position the athlete is comfortable and the hand 48 is optimally supported on its heal so that a good quality autograph 50 is obtained.

Sixth, after the autograph process is complete, the autograph seeker or fan can write, preferably in indelible ink, the details of the autograph obtained. The back of the board 36 could include a permanently affixed label 54 documenting the fan and the athlete's personal information and a ledger documenting the dates and those athletes who signed the ball period.

Seventh, and last, when the process is completed the ball can be either hung from a vertical wall or displayed on a flat surface supported by the right and left frame support 38A and 38B.

One of the big problems for individuals who acquire sports memorabilia such as signed autographed balls, is that so many are fake, because the have no provenance, or are so baldly faded or worn that their value has been greatly diminished. The present invention 10 virtually solves all these problems while making possible for the fan, who might be a small child, to obtain a very high quality autograph that he or she may cherish for the rest of his or her life.

While the invention has been described with reference to the preferred embodiment thereof, it will be appreciated by those with ordinary skill in the art that various modifications can be made to the parts that comprise the invention without departing from the spirit and scope of the invention as a whole.

I claim:

1. An autograph board apparatus for holding a baseball to be autographed, said apparatus comprising:

a board having an aperture with a periphery therein;

a baseball receiving means attached to said board at the periphery of said aperture for receiving the baseball, wherein said baseball receiving means has a hemispherical cross-section and a radius $R_r$ and wherein the baseball has a radius $R_b$ and wherein said radius $R_r$ is sufficiently close to said radius $R_b$ so that the baseball will be held snugly so that it will not rotate while being autographed but also not so snugly that it cannot be easily removed from said baseball receiving means; and, a cover means attached to said board for covering the baseball when the baseball is held in said baseball receiving means; and, hinge means for rotatably attaching said cover means to said board, wherein said cover means can be rotated away from said baseball receiving means so that the baseball can be autographed and said cover means can thereafter be returned back into position to protect the baseball after the baseball has been autographed.

2. An autograph board apparatus for holding an object to be autographed, said apparatus comprising:

a board having an aperture with a periphery therein; and, an object receiving means attached to said board at the periphery of said aperture for receiving the object, wherein said object receiving means has a circular cross-section and a radius $R_r$ and wherein the object has a radius $R_o$ and wherein said radius $R_r$ is sufficiently close to said radius $R_o$ so that the object will be held snugly so that it will not rotate while being autographed but also not so snugly that it cannot be easily removed from said object receiving means; and, a cover means attached to said board for covering the object when the object is held in said object receiving means; and, hinge means for rotatably attaching said cover means to said board, wherein said cover means can be rotated away from said object receiving means so that the object can be autographed and said cover means can thereafter be returned back into position to protect the object after the object has been autographed.

3. The apparatus of claim 2 wherein the object is selected from the group consisting of a baseball, a tennis ball, a hockey puck, a basketball and a football.

4. The apparatus of claim 3 wherein the object is a baseball.

5. The apparatus of claim 4 wherein the object is a baseball card.

6. The apparatus of claim 5 further comprising:

an area on said board specifically intended to accept a hand written inscription of an athlete and a description of an event.

7. The apparatus of claim 2 wherein the object is selected from the group consisting of a baseball, a tennis ball, a hockey puck, a basketball and a football.

* * * * *